US010837228B2

(12) United States Patent
Roberts et al.

(10) Patent No.: US 10,837,228 B2
(45) Date of Patent: Nov. 17, 2020

(54) SECURITY SCREEN MOUNTING SYSTEM AND METHOD THEREFOR

(71) Applicants: Don Roberts, Tupelo, MS (US); James Wilford Roberts, Saltillo, MS (US)

(72) Inventors: Don Roberts, Tupelo, MS (US); James Wilford Roberts, Saltillo, MS (US)

( * ) Notice: Subject to any disclaimer, the term of this patent is extended or adjusted under 35 U.S.C. 154(b) by 152 days.

(21) Appl. No.: 15/833,675

(22) Filed: Dec. 6, 2017

(65) Prior Publication Data

US 2018/0094477 A1 Apr. 5, 2018

(51) Int. Cl.
*E06B 9/52* (2006.01)
*E06B 9/04* (2006.01)
*E06B 9/24* (2006.01)

(52) U.S. Cl.
CPC ..... *E06B 9/52* (2013.01); *E06B 9/04* (2013.01); *E06B 9/24* (2013.01)

(58) Field of Classification Search
CPC ..... E06B 9/52
USPC ..... 49/504, 400–402; 52/656.7
See application file for complete search history.

(56) References Cited

U.S. PATENT DOCUMENTS 1,859,974 A * 5/1932 Kroenke ..... E06B 9/52 160/97
1,919,367 A * 7/1933 Hamm ..... B61D 25/00 49/408
2,204,761 A * 6/1940 Lang ..... E06B 9/52 160/369
2,345,886 A * 4/1944 Charles ..... E06B 3/28 160/182
2,396,295 A * 3/1946 Spraragen ..... E06B 9/52 160/40
2,719,340 A * 10/1955 Best ..... E06B 3/4618 52/207
3,868,789 A * 3/1975 Gates ..... B29C 35/04 49/501
4,944,118 A * 7/1990 Biro ..... E06B 3/44 49/504
5,141,046 A * 8/1992 Duncan ..... E06B 9/52 160/371

(Continued)

FOREIGN PATENT DOCUMENTS

CA 2925913 A1 * 10/2016 ..... E06B 9/52
DE 4308956 A1 * 9/1994 ..... E06B 9/52

(Continued)

OTHER PUBLICATIONS

Machine translation of DE4308956A1.*

*Primary Examiner* — Marcus Menezes
(74) *Attorney, Agent, or Firm* — Kenneth E Barnes

(57) ABSTRACT

A mounting system and method for security screens for use with double-hung windows and other windows having an integral screen track is disclosed. The mounting system and method according to the present invention reduces materials cost for manufacture of security screens while improving aesthetics of the installation and allowing installation to be accomplished from the interior side of the window, and permits installation of security screens either at the construction site or during window manufacture, while preserving the window manufacturer's warranty. Exemplary embodiments both with and without a subframe are described.

14 Claims, 9 Drawing Sheets

(56) References Cited

U.S. PATENT DOCUMENTS

| | | | | | |
|---|---|---|---|---|---|
| 5,231,809 | A * | 8/1993 | Benjamin | B60P 3/32 | 135/117 |
| 5,535,550 | A * | 7/1996 | Yang | E05B 65/1053 | 292/92 |
| 6,176,041 | B1 * | 1/2001 | Roberts | E05C 9/045 | 49/395 |
| 8,136,326 | B2 * | 3/2012 | Yan | E06B 5/11 | 52/311.1 |
| 2002/0020124 | A1 * | 2/2002 | Kusano | E05D 7/02 | 52/213 |
| 2008/0302490 | A1 * | 12/2008 | Wilson | E06B 9/52 | 160/371 |
| 2009/0071087 | A1 * | 3/2009 | Achen | E06B 7/02 | 52/302.1 |
| 2009/0173462 | A1 * | 7/2009 | Elfers | E06B 9/52 | 160/371 |
| 2010/0180504 | A1 * | 7/2010 | Kernaghan | E06B 3/4618 | 49/50 |
| 2015/0284994 | A1 * | 10/2015 | Richter | E06B 9/52 | 160/92 |
| 2016/0376835 | A1 * | 12/2016 | Massey | E06B 7/16 | 49/398 |

FOREIGN PATENT DOCUMENTS

| | | | | |
|---|---|---|---|---|
| DE | 102013224658 | A1 * | 6/2015 | E06B 9/52 |
| WO | WO-2008018372 | A1 * | 2/2008 | E06B 9/52 |

* cited by examiner

Prior Art

SECURITY SCREEN MOUNTING SYSTEM AND METHOD THEREFOR

BACKGROUND OF THE INVENTION

Security screens are a popular option to protect windows of businesses and homes from unauthorized intrusion such as burglars breaking the window to gain access, hail or other weather conditions, and other types of damage. Many commonly installed windows are made from materials such as "vinyl" (poly vinyl chloride, or PVC) or fiberglass that due to their relative strength in comparison to materials such as aluminum or wood, are not suitable for using mechanical fasteners such as screws to attach the security screen directly to the window. Also, direct attachment to the window itself, regardless of the material the window is made from, would cause damage such as punctures that could produce leaks and could void the window manufacturer's warranty. Consequently, existing systems and methods for installing security screens attach the screens to the exterior wall surrounding the window opening, either directly, or using spacers to build out around the window to provide clearance for the installation of the screen in circumstances where the window has not been installed recessed or flush relative to the wall surface. Security screens attached to the wall surrounding the window opening must thus be as large as, or often larger, than the window they are to protect, which is both aesthetically undesirable and increases manufacturing cost for the screens due to increasing the amount of materials required for their construction. A need therefore exists for a security screen mounting system and method which will not cause damage to the window that could void the window manufacturer's warranty, reduces manufacturing cost for the security screen, and improves the aesthetics of the installed screens by not hiding the window entirely behind an oversized security screen.

REFERENCE NUMBERS

100 Security screen (prior art)
110 Screen subframe (prior art)
112 Mounting flange (prior art)
120 Screen main frame (prior art)
130 Fasteners (prior art)
140 Spacers (prior art)
160 Window frame
162 Header
164 Left jamb
166 Right jamb
170 Screen track
200 Security screen
220 Screen subframe
240 Screen main frame
242 Screen
244 Screen retaining strip
246 Weatherstripping
260 Hinge
280 Latch
300 Security screen (center hinged)
320 Screen panels
322 Fixed screen panel
324 Working screen panel
340 Connecting hinge

400 Mounting rail
420 Fasteners

DETAILED DESCRIPTION OF THE DRAWINGS

Figure 1:
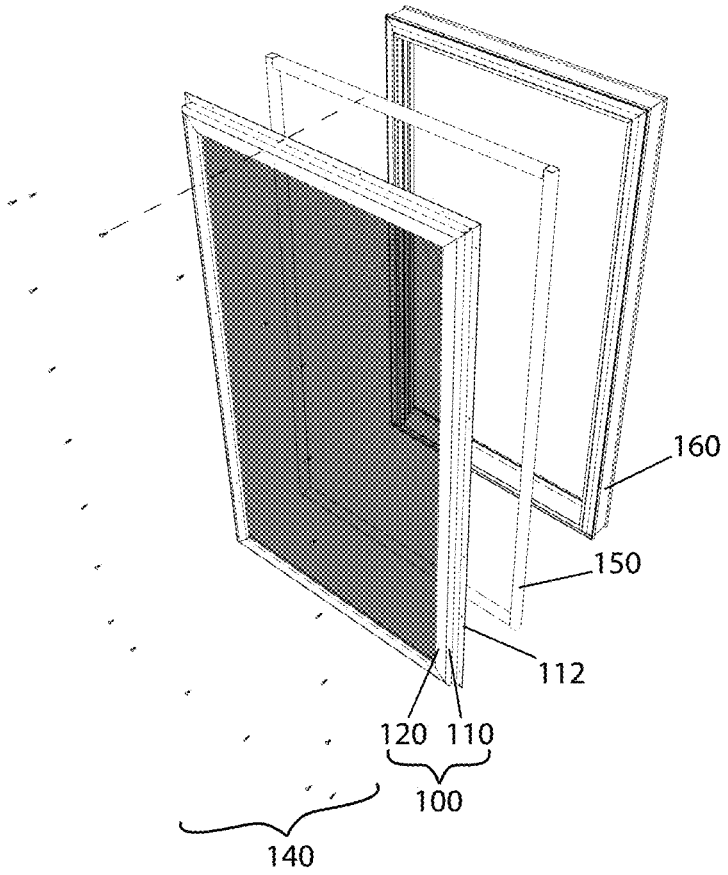
FIG. 1 is an exploded oblique front elevation view of a hinged security screen in closed position illustrating a prior art mounting method.

FIG. 1 is an exploded oblique front elevation view of a hinged security screen in closed position illustrating a prior art mounting method. Existing security screens 100 are mounted to the wall (not shown) surrounding the window frame 160 using fasteners 130 such as screws, either directly, by attaching the security screen 100 to wall structure, such as brick or wood, or indirectly through the use of spacers 140 which are attached to wall structure, and which the screen 100 is then attached to. The spacers 140 may be wood, or as shown, metal tubing, such as aluminum, which can be used to build up around windows which are not mounted flush to the wall surface, so as to provide sufficient clearance for installation. The security screen 100 includes a mounting flange 112 through which fasteners 130 are driven into the surrounding wall structure or into spacers 140 attached to the wall structure. For clarity of illustration, only the window frame 160 is illustrated, and the sashes of the window being protected are not shown.

Figure 2:
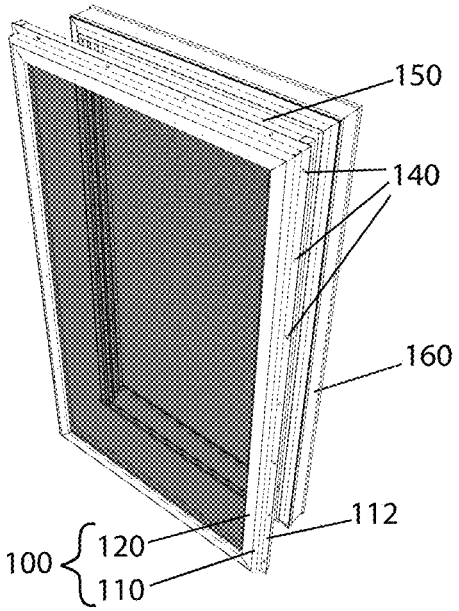
Prior Art FIG. 2
FIG. 2 is an assembled oblique front elevation view of a hinged security screen in closed position illustrating a prior art mounting method.

FIG. 2 is an assembled oblique front elevation view of a hinged security screen in closed position illustrating a prior art mounting method. Fasteners 130, such as screws, are used to attach the security screen 100 to wall structure (not shown) surrounding the window frame 160, either by driving them directly through the mounting flange 112 into surrounding wall structure, such as brick or wood, or as illustrated here, into spacers 140 which are attached to surrounding wall structure. The spacers 140 may be wood, or as shown, metal tubing, such as aluminum, which can be used to build up around windows which are not mounted flush to the wall surface, so as to provide sufficient clearance for installation. For clarity of illustration, only the window frame 160 is illustrated, and the sashes of the window being protected are not shown. Attaching the security screen 100 to surrounding wall structure requires that the screen be as large or larger than the window to be protected, which is both aesthetically undesirable and increases manufacturing cost for the screens due to increasing the amount of materials required for their construction. Attachment to the surrounding wall structure has also been necessary because the materials many commonly installed windows are made from, such as "vinyl" (poly vinyl chloride, or PVC) or fiberglass are not suitable for using mechanical fasteners such as screws to attach the security screen directly to the window, due to their relative strength in comparison to materials such as aluminum or wood. Direct attachment to the window itself, regardless of the material the window is made from, would also cause damage such as punctures that could produce leaks and could void the window manufacturer's warranty.

Figure 3:
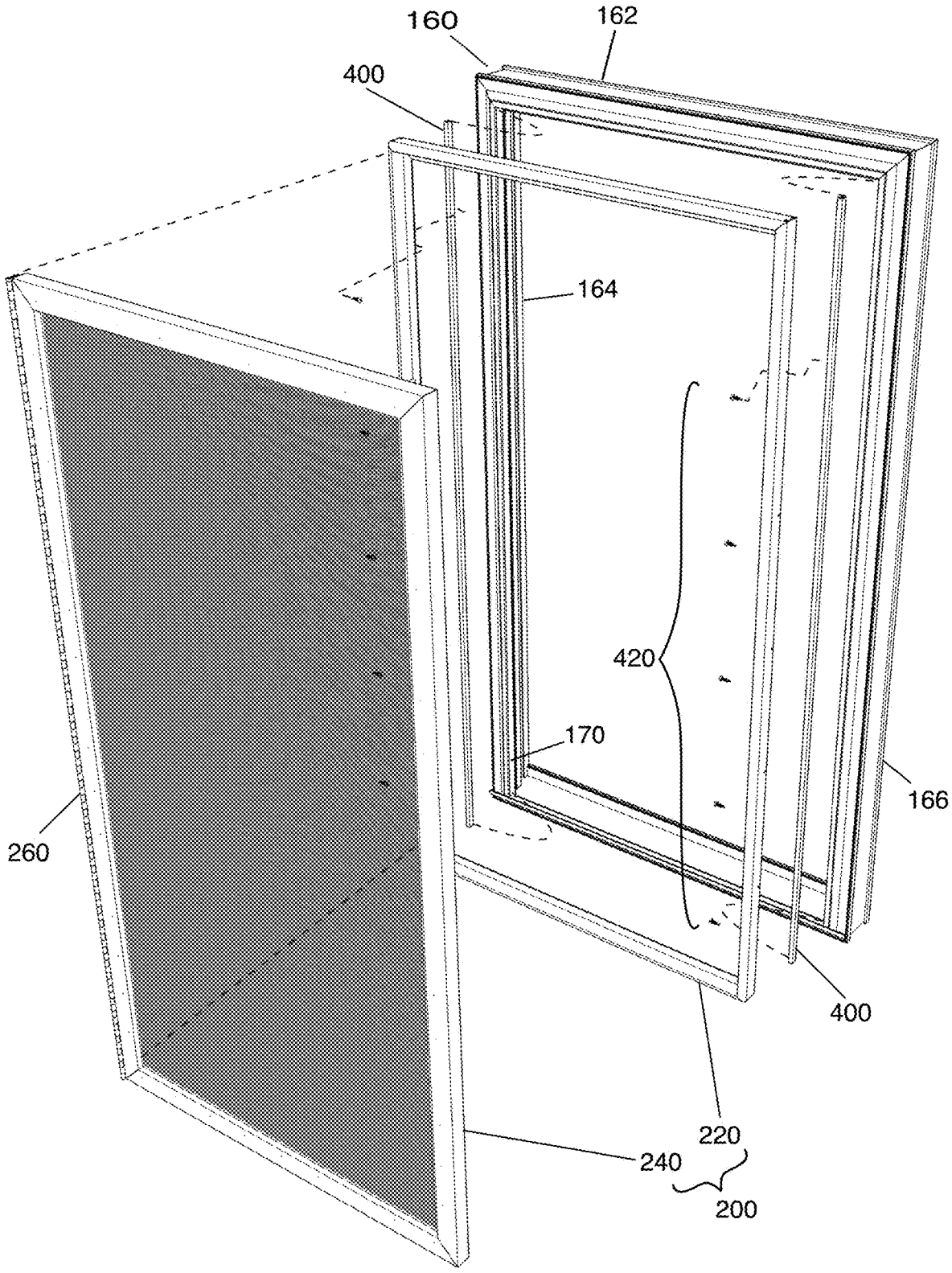
FIG. 3 is an exploded oblique front elevation view of a hinged security screen in closed position illustrating a mounting method according to an embodiment of the invention.

FIG. 3 is an exploded oblique front elevation view of a hinged security screen in closed position illustrating a mounting method according to an embodiment of the invention. For windows having an integral screen track 170 as part of the window frame 160, which would include most double-hung windows, a security screen 200 can be sized to fit between the screen track 170 in the left jamb 164 and the screen track 170 in the right jamb 166. The security screen 200 according to the present invention is thus smaller in size than prior art security screens (see FIGS. 1 and 2) relative to the window to be protected and the mounting method according to the present invention does not require a mounting flange, reducing materials requirements for construction and manufacture of the security screen 200. According to the mounting method of the present invention, a plurality of mounting rails 400 which are sized and configured to fit within the integral screen track 170 of the window frame 160 is inserted in the integral screen track 170 and sized to the length of a portion of the integral screen track 170, such as the length of the integral screen track 170 of the left jamb 164 and the integral screen track 170 of the right jamb 166. Optionally, a mounting rail 400 sized and configured to fit within the integral screen track 170 of the header 162 of the window and sized to the length of the integral screen track 170 of the header 162 may be used, if desired, and can provide additional strength to the installation. The security screen 200 according to the present invention is attached to the plurality of mounting rails 400 inserted in the integral screen track 170 of the window frame 160 using fasteners 420, such as screws, and in a preferred embodiment, self-tapping screws are used which may be inserted through pre-drilled holes in the security screen 200, and driven into the mounting rails 400. The mounting rails 400 may be made of any suitable rigid material, such as metal, wood, polymer or composite materials, and in a preferred embodiment are metal tubing having a substantially rectangular cross section, such as aluminum tubing. Although four-sided hollow rectangular tubing is shown as the mounting rails 400, "U"-channel or solid bar stock may also be used, and bolts or machine screws could be used for the fasteners 420 attaching the security screen 200 to mounting rails 400 having threaded holes. For clarity of illustration, only the window frame 160 is illustrated, and the sashes of the window being protected are not shown.

Figure 4:
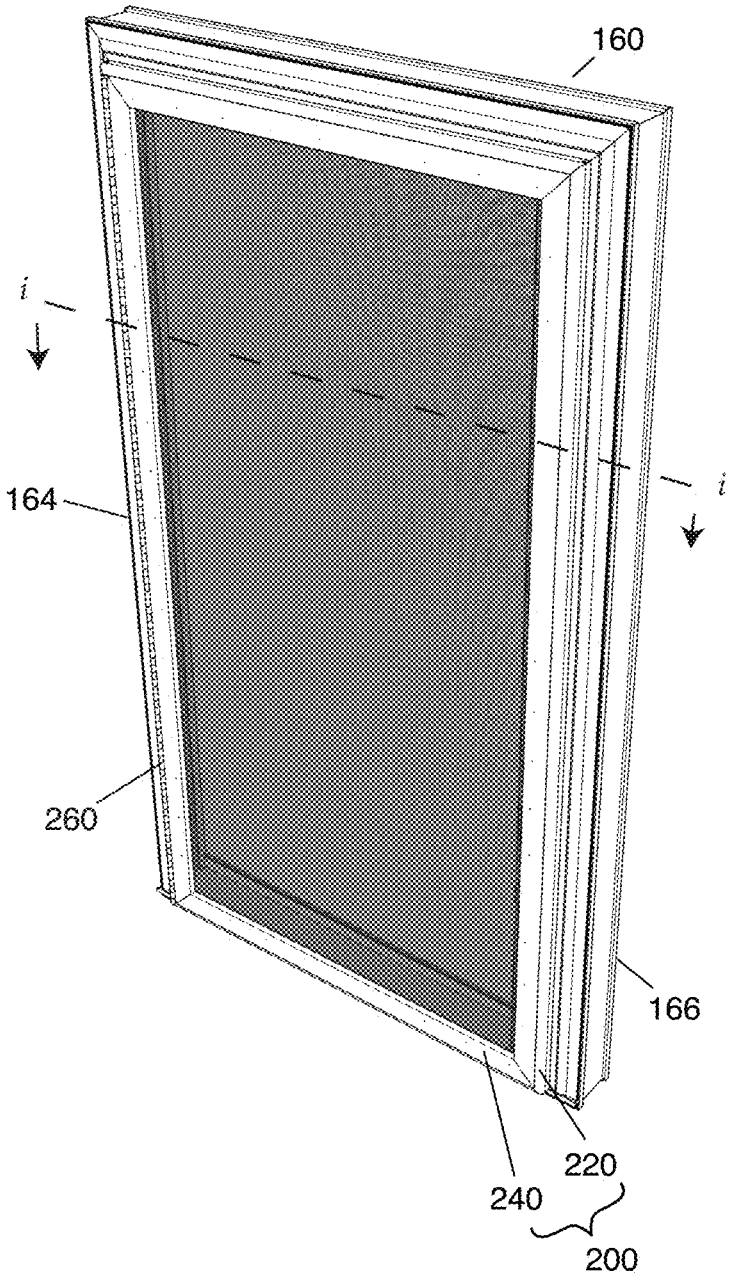
FIG. 4 is an assembled oblique front elevation view of a hinged security screen in closed position illustrating a mounting method according to an embodiment of the invention.

FIG. 4 is an assembled oblique front elevation view of a hinged security screen in closed position illustrating a mounting method according to an embodiment of the invention. The security screen 200 according to the present invention is smaller than prior art security screens (see FIGS. 1 and 2), and the mounting method according to the present invention does not require a mounting flange (112 of FIGS. 1 and 2) enhancing the aesthetics of the installed security screen 200. The mounting method according to the present invention may also be performed from the interior side of the window, in contrast to the prior art, because the fasteners 420 used to attach the security screen 200 to the plurality of mounting rails 400 are on the interior side, and not readily accessible or visible from the exterior side of the security screen when the security screen 200 is in the closed position, as illustrated here. This lack of readily visible fasteners 420, such as screws, on the exterior side of the screen both enhances aesthetic appearance of the installation, and prevents access from the exterior side to the fasteners 420 attaching the security screen 200 to the mounting rails 400 within the integral screen track 170 of the window frame 160. For clarity of illustration, only the window frame 160 is illustrated, and the sashes of the window being protected are not shown. Security screens according to the present invention may also be installed on single-hung windows provided they have the necessary integral screen track, but installing security screens according to the method of the present invention on a single-hung window would be very difficult to do in the field, so it is preferred that the installation of the security screens on single-hung windows according to the method of the present invention be done at the factory during window manufacture. Installation of the security screens on double-hung windows according to the method of the present invention may be done in the field after window installation, or alternatively can be done at the factory during window manufacture. Installation of security screens at the factory during window manufacture is another advantage of the present invention, and can greatly simplify installation at the construction site when compared to installing windows and security screens as separate steps, particularly in contrast to the prior art mounting method shown in FIGS. 1 & 2. Additionally, security screens which are non-operating, or fixed, rather than hinged and able to open, may be installed in the field according to the method of the present invention on operating double-hung windows having the necessary integral screen track, provided the installation is performed from the interior side of the window.

Figure 5:
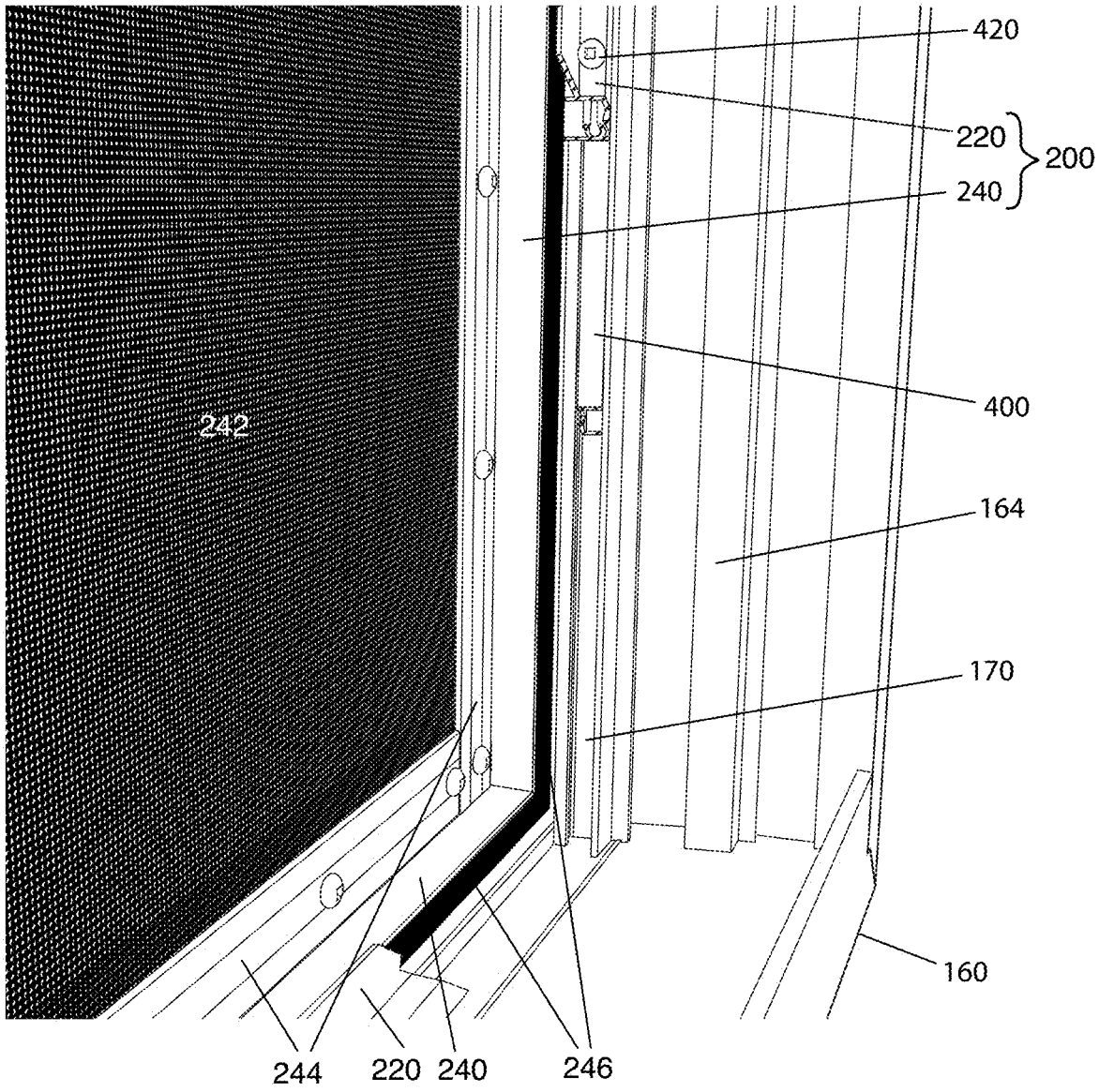
FIG. 5 is an assembled detail partial cutaway oblique rear elevation view of the fixed security screen of FIG. 4, illustrating a mounting method according to an embodiment of the invention.

FIG. 5 is an assembled detail partial cutaway oblique rear elevation view of the fixed security screen of FIG. 4, illustrating a mounting method according to an embodiment of the invention. According to the mounting method of the present invention, a plurality of mounting rails 400 which are sized and configured to fit within the integral screen track 170 of the window frame 160 is inserted in the integral screen track 170 and sized to the length of a portion of the integral screen track 170, such as the length of the integral screen track 170 of the left jamb 164 and the integral screen track 170 of the right jamb 166. A detail view of the interior side of the left jamb is shown, illustrating the integral screen track 170 of the window frame, the mounting rail 400 within, and attachment of the security screen 200 to the mounting rail 400 using fasteners 420, such as screws. In a preferred embodiment, self-tapping screws are used which may be inserted through pre-drilled holes in the security screen 200, and driven into the mounting rails 400. The mounting rails 400 may be made of any suitable rigid material, such as metal, wood, polymer or composite materials, and in a preferred embodiment are metal tubing having a substantially rectangular cross section, such as aluminum tubing. Although four-sided hollow rectangular tubing is shown as the mounting rails 400, "U"-channel or solid bar stock may also be used, and bolts or machine screws could be used for the fasteners 420 attaching the security screen 200 to mounting rails 400 having threaded holes. For clarity of illustration, only the window frame 160 is illustrated, and the sashes of the window being protected are not shown.

Figure 6:
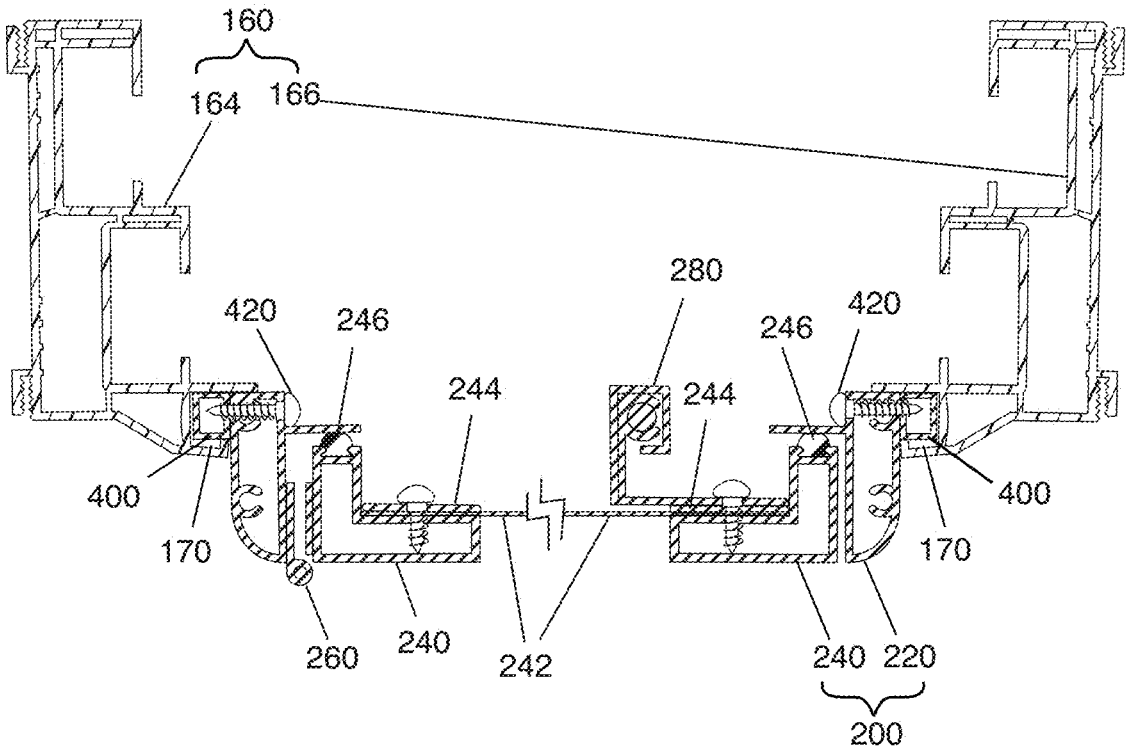
FIG. 6 is an assembled cross-sectional plan view of the hinged security screen of FIG. 4 sectioned along line i-i and illustrating a mounting method according to an embodiment of the invention.

FIG. 6 is an assembled cross-sectional plan view of the hinged security screen of FIG. 4 sectioned along line i-i and illustrating a mounting method according to an embodiment of the invention. For windows having an integral screen track 170 as part of the window frame 160, which would include most double-hung windows, a security screen 200 can be sized to fit between the screen track 170 in the left jamb 164 and the screen track 170 in the right jamb 166. In an exemplary embodiment, the security screen 200 consists of a screen subframe 220 and a screen main frame 240, the screen main frame 240 being pivotably mounted to the screen subframe 220 by a hinge 260, or other pivoting attachment means. This allows the security screen 200 to be pivoted open in the event access or egress through the window is needed, such as during an emergency. In a preferred embodiment, the screen main frame 240 and screen subframe 220 are made of metal, such as extruded aluminum, and the hinge is a steel piano hinge. As known in the art, screen retaining strips 244 may be used to attach the screen 242 to the screen main frame 240, and the screen main frame 240 may include weatherstripping 246 on the side contacting the screen subframe 220. In a preferred embodiment, most of the visible parts, including the screen main frame 240, screen subframe 220, hinge 260, and screen 242 are powder-coated for appearance and durability. Mounting rails 400 that are sized and configured to fit within the integral screen track 170 of the window frame 160 are inserted in the integral screen track 170 and sized to the length of a portion of the integral screen track 170, such as the length of the integral screen track 170 of the left jamb 164 and the integral screen track 170 of the right jamb 166. The screen subframe 220 is attached to the mounting rails 400 using fasteners 420, such as screws, and in a preferred embodiment the screws are self-tapping screws which are inserted into pre-drilled holes in the screen subframe 220 and driven into the mounting rails 400. The mounting rails 400 may be made of any suitable rigid material, such as metal, wood, polymer or composite materials, and in a preferred embodiment are metal tubing having a substantially rectangular cross section, such as aluminum tubing. Although four-sided hollow rectangular tubing is shown as the mounting rails 400, "U"-channel or solid bar stock may also be used, and bolts or machine screws could be used for the fasteners 420 attaching the security screen 200 to mounting rails 400 having threaded holes. A latching means, such as a latch 280 or barrel bolt may be used to reversibly secure the screen main frame 240 to the screen subframe 220 to prevent opening the security screen 200 until released from the interior side of the window. In a preferred embodiment, the latch 280 is a single-point latch as disclosed in U.S. Pat. No. 6,176,041. For clarity of illustration, only the window frame 160 is illustrated, and the sashes of the window being protected are not shown.

Figure 7:
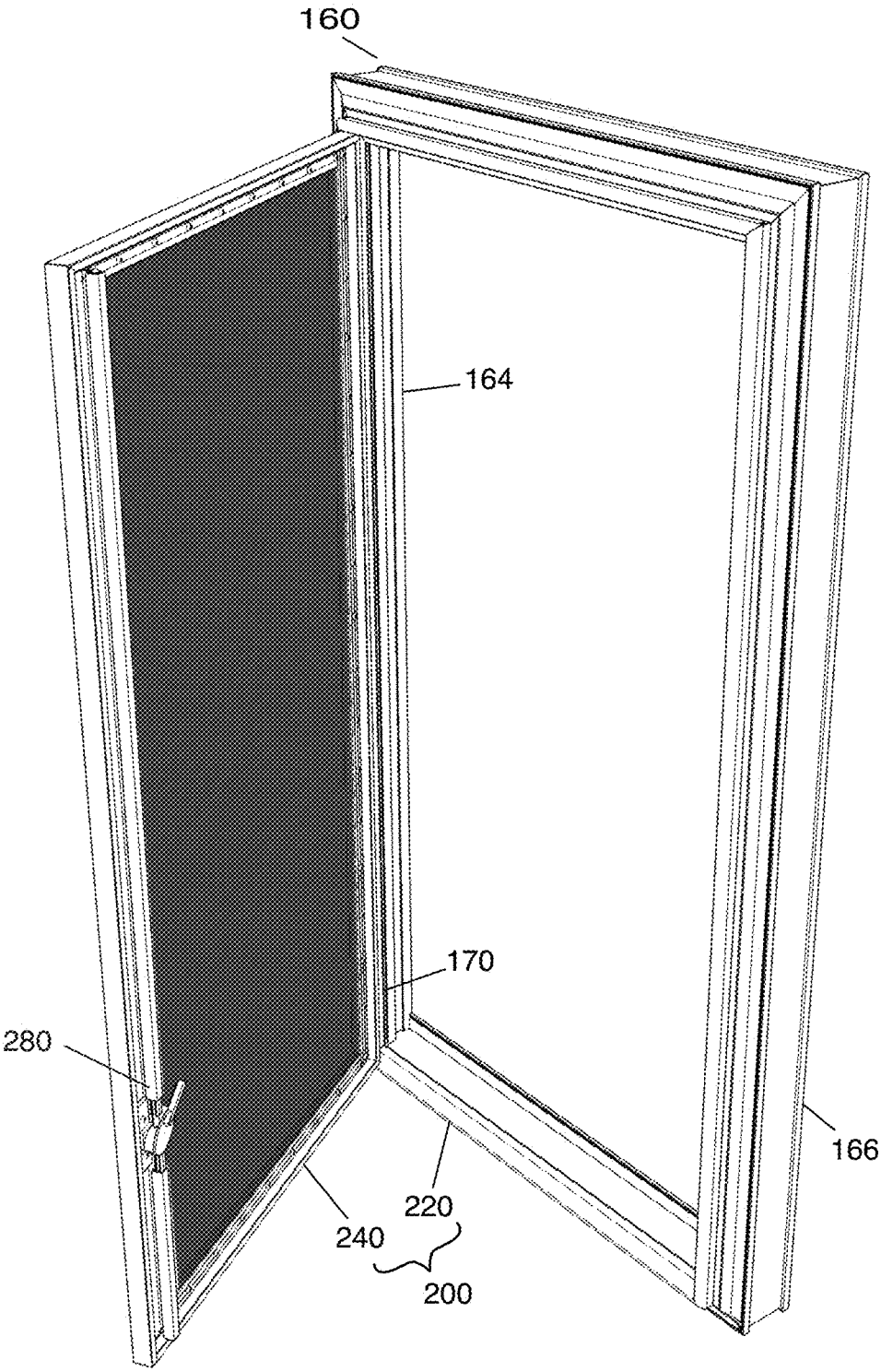
FIG. 7 is an assembled oblique front elevation view of a hinged security screen in open position illustrating a mounting method according to an embodiment of the invention.

FIG. 7 is an assembled oblique front elevation view of a hinged security screen in open position illustrating a mounting method according to an embodiment of the invention. For windows having an integral screen track 170 as part of the window frame 160, which would include most double-hung windows, a security screen 200 can be sized to fit between the screen track 170 in the left jamb 164 and the screen track 170 in the right jamb 166. In an exemplary embodiment, the security screen 200 consists of a screen subframe 220 and a screen main frame 240, the screen main frame 240 being pivotably mounted to the screen subframe 220 by a hinge 260, or other pivoting attachment means. This allows the security screen 200 to be pivoted open in the event access or egress through the window is needed, such as during an emergency. In place of the hinge 260, pivot pins may be used as known in the art, to pivotably mount the screen main frame 240 to the screen subframe 220. In a preferred embodiment, the screen main frame 240 and screen subframe 220 are made of metal, such as extruded aluminum, and the hinge is a steel piano hinge. Besides the left jamb 164 as shown here, the hinge 260 or other pivotable mounting means may be located at the header side of the security screen 200 or the or right jamb side 166 as desired. A latching means, such as a latch 280 or barrel bolt, located at the side of the security screen 200 opposite to the hinge 260 or other pivotable mounting means, may be used to reversibly secure the main screen frame 240 to the screen subframe 220 to prevent opening the security screen 200 until released from the interior side of the window. In a preferred embodiment, the latch 280 is a single-point latch as disclosed in U.S. Pat. No. 6,176,041. For clarity of illustration, only the window frame 160 is illustrated, and the sashes of the window being protected are not shown.

Figure 8:
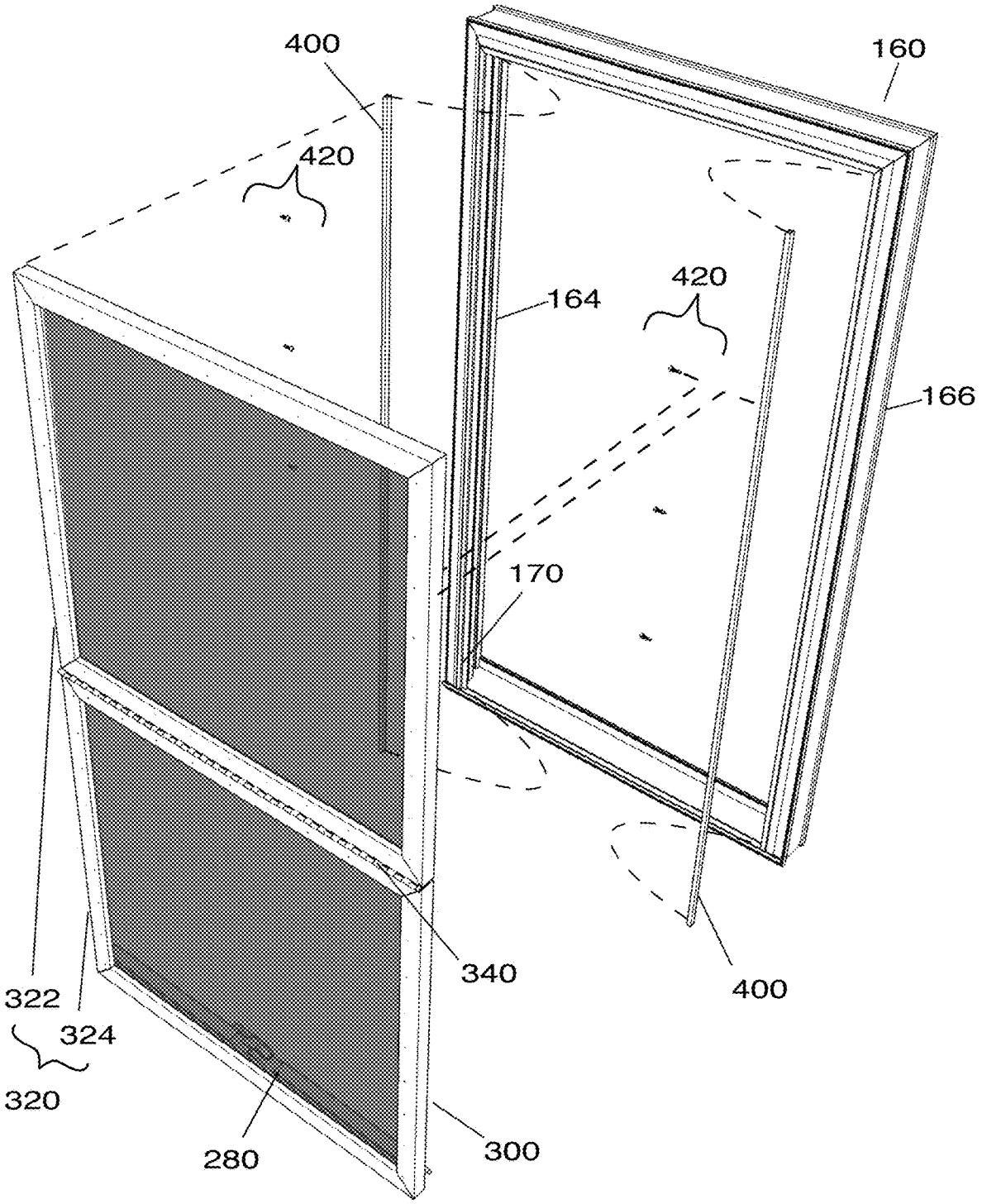
FIG. 8 is an exploded oblique front elevation view of a hinged security screen in closed position illustrating a mounting method according to an embodiment of the invention.

FIG. 8 is an exploded oblique front elevation view of a hinged security screen in closed position illustrating a mounting method according to an embodiment of the invention. According to another embodiment of the invention, for windows having an integral screen track 170 as part of the window frame 160, which would include most double-hung windows, a security screen 300 having a connecting hinge 340 can be sized to fit between the integral screen track 170 in the left jamb 164 and the integral screen track 170 in the right jamb 166. The security screen 300 of this embodiment does not include a screen subframe 220 (see FIGS. 3-7) but consists of a plurality of screen panels 320 dividing the space between the opposing sides of the integral screen track 170, the plurality of screen panels 320 joined by at least one connecting hinge 340. In an exemplary embodiment, as shown, two screen panels 320 are joined by a horizontal connecting hinge 340. A plurality of mounting rails 400, sized and configured to fit within the integral screen track 170 of the window frame 160 are inserted in the integral screen track 170 and sized to the length of a portion of the integral screen track 170, such as the length of the integral screen track 170 of the left jamb 164 and the integral screen track 170 of the right jamb 166. A fixed screen panel 322 is attached to the plurality of mounting rails 400 using fasteners 420, such as screws, and in an preferred embodiment the screws are self-tapping screws which are inserted into pre-drilled holes in the fixed screen panel 322 and driven into the mounting rails 400. A working screen panel 324 is pivotably mounted to the fixed screen panel 322 by a connecting hinge 340, or other pivoting attachment means. This allows the working screen panel 324 of the security screen 300 to be pivoted open in the event access or egress through the window is needed, such as during an emergency. For clarity of illustration, only the window frame 160 is illustrated, and the sashes of the window being protected are not shown.

Figure 9:
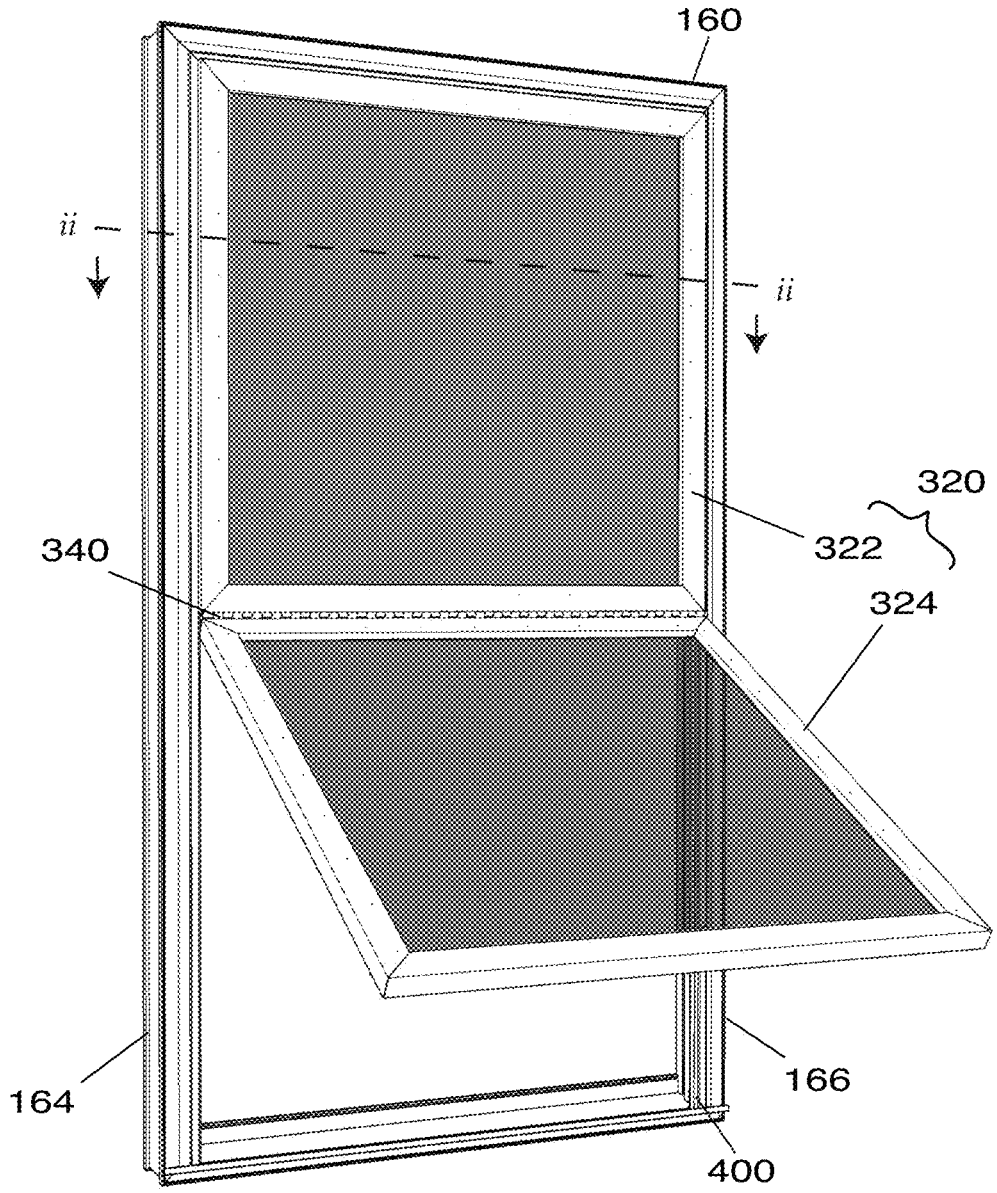
FIG. 9 is an assembled oblique front elevation view of a hinged security screen in open position illustrating a mounting method according to an embodiment of the invention.

FIG. 9 is an assembled oblique front elevation view of a hinged security screen in open position illustrating a mounting method according to an embodiment of the invention. According to an embodiment of the invention, for windows having an integral screen track 170 as part of the window frame 160, which would include most double-hung windows, a security screen 300 having a connecting hinge 340 can be sized to fit between the integral screen track 170 in the left jamb 164 and the integral screen track 170 in the right jamb 166. In an exemplary embodiment, as shown, two screen panels 320 are joined by a horizontal connecting hinge 340. A plurality of mounting rails 400, sized and configured to fit within the integral screen track 170 of the window frame 160 are inserted in the integral screen track 170 and sized to the length of a portion of the integral screen track 170, such as the length of the integral screen track 170 of the left jamb 164 and the integral screen track 170 of the right jamb 166. A fixed screen panel 322 is attached to the plurality of mounting rails 400 using fasteners 420, such as screws, and in a preferred embodiment the screws are self-tapping screws which are inserted into pre-drilled holes in the fixed screen panel 322 and driven into the mounting rails 400. A working screen panel 324 is pivotably mounted to the fixed screen panel 322 by a connecting hinge 340, or other pivoting attachment means. The mounting rails 400 may be made of any suitable rigid material, such as metal, wood, polymer or composite materials, and in a preferred embodiment are metal tubing having a substantially rectangular cross section, such as aluminum tubing. Although four-sided hollow rectangular tubing is shown as the mounting rails 400, "U"-channel or solid bar stock may also be used, and bolts or machine screws could be used for the fasteners 420 attaching the fixed screen panel 322 to mounting rails 400 having threaded holes. In the exemplary embodiment shown, the mounting rails 400 run the full lengths of the integral screen track 170 of the left jamb 164 and the integral screen track 170 of the right jamb 166, supporting the fixed screen panel 322 and preventing it from sliding downward along with the mounting rails 400, which it might do if the mounting rails 400 were shorter, or only the same length as the sides of the fixed screen panel 322. A latching means, such as a latch 280 or barrel bolt, located at the side of the working screen panel 324 opposite to the connecting hinge 340 or other pivotable mounting means, may be used to reversibly secure the working screen panel 324 to the window frame 160 to prevent opening the working screen panel 324 until released from the interior side of the window. In a preferred embodiment, the latch 280 is a single-point latch as disclosed in U.S. Pat. No. 6,176,041. For clarity of illustration, only the window frame 160 is illustrated, and the sashes of the window being protected are not shown.

Figure 10:
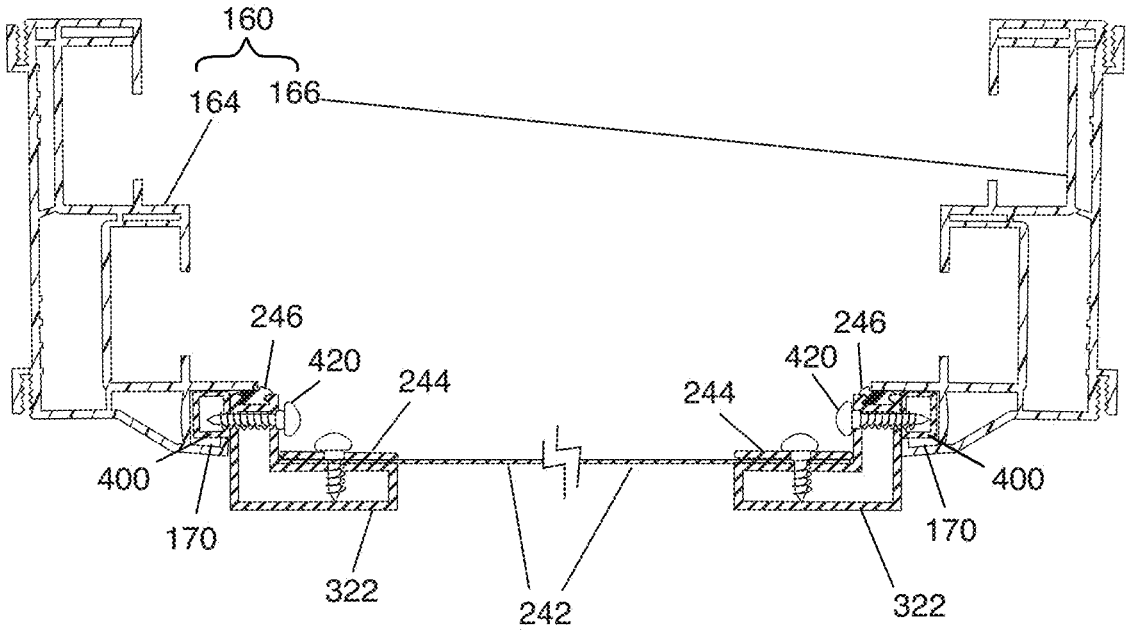
FIG. 10 is an assembled cross-sectional plan view of the hinged security screen of FIG. 9 sectioned along line ii-ii and illustrating a mounting method according to an embodiment of the invention.

FIG. 10 is an assembled cross-sectional plan view of the hinged security screen of FIG. 9 sectioned along line ii-ii and illustrating a mounting method according to an embodiment of the invention. The screen panels 320 of this embodiment have the same profile as the screen main frame 240 of the embodiment shown in FIGS. 3-7 but instead of being used with a screen subframe 220, the fixed screen panel 322 of this embodiment is attached directly to the mounting rails 400 using fasteners 420, such as screws, and in a preferred embodiment the screws are self-tapping screws which are inserted into pre-drilled holes in the fixed screen panel 322 and driven into the mounting rails 400. In a preferred embodiment, the screen panels 320 are made of metal, such as extruded aluminum, and the connecting hinge is a steel piano hinge. As known in the art, screen retaining strips 244 may be used to attach the screen 242 to the screen panels 320, and the screen panels may include weatherstripping 246 on the side contacting the window frame 160. In a preferred embodiment, most of the visible parts, including the screen panels 320, screen connecting hinge 340, and screen 242 are powder-coated for appearance and durability.

We claim:

1. A system for mounting a security screen to a window frame, said window frame having frame members consisting of a header, a left jamb, a right jamb, and a sill, said window frame having in an exterior portion of each of at least two opposed frame members of said window frame a U-shaped integral screen track, the system comprising a plurality of mounting rails configured to fit within said integral screen track of said each of at least two opposed frame members, said security screen configured to fit between said plurality of mounting rails, and an attachment means to attach said security screen to said plurality of mounting rails.

2. The system of claim 1, wherein said at least two opposed frame members of said window frame are the left jamb and the right jamb, and at least two of the said plurality of mounting rails are configured to fit within said U-shaped integral screen track of the left jamb and the right jamb of said window frame.

3. The system of claim 2, wherein the header of said window frame has in an exterior portion thereof a U-shaped integral screen track, the system further comprising a mounting rail configured to fit within said U-shaped integral screen track of the header of said window frame.

4. The system of claim 1, wherein the attachment means comprises screws.

5. The system of claim 1, wherein each of said plurality of mounting rails further comprises at least one threaded hole, and the attachment means comprises bolts.

6. The system of claim 2, wherein the security screen comprises a subframe, and a main frame pivotably attached to said subframe.

7. The system of claim 6, wherein the security screen further comprises a latching means configured to reversibly secure the main frame to said subframe.

8. The system of claim 6, wherein the attachment means to attach said security screen to said plurality of mounting rails comprises screws attaching said subframe to said plurality of mounting rails.

9. The system of claim 8, wherein the security screen further comprises a latching means configured to reversibly secure the main frame to said subframe.

10. A system for mounting a security screen to a window frame, said window frame having frame members consisting of a header, a left jamb, a right jamb, and a sill, said window frame having in an exterior portion of each of at least two opposed frame members of said window frame a U-shaped integral screen track, the system comprising a plurality of mounting rails configured to fit within said integral screen track of said each of at least two opposed frame members; said security screen comprising a subframe, a main frame, and a latching means; said subframe configured to fit between said plurality of mounting rails and attached to said plurality of mounting rails by an attachment means, said mainframe pivotably attached to said subframe, and said latching means configured to reversibly secure said main frame to said subframe.

11. The system of claim 10, wherein said at least two opposed frame members of said window frame are the left jamb and the right jamb, and at least two of the said plurality of mounting rails are configured to fit within said U-shaped integral screen track of the left jamb and the right jamb of said window frame.

12. The system of claim 11, wherein the header of said window frame has in an exterior portion thereof a U-shaped integral screen track, the system further comprising a mounting rail configured to fit within said U-shaped integral screen track of the header of said window frame.

13. The system of claim 10, wherein said attachment means comprises screws.

14. The system of claim 10, wherein each of said plurality of mounting rails further comprises at least one threaded hole, and the attachment means comprises bolts.

* * * * *